US009991607B1

(12) United States Patent
West et al.

(10) Patent No.: US 9,991,607 B1
(45) Date of Patent: Jun. 5, 2018

(54) CIRCULAR ARRAY OF RIDGED WAVEGUIDE HORNS

(71) Applicant: Rockwell Collins, Inc., Cedar Rapids, IA (US)

(72) Inventors: James B. West, Cedar Rapids, IA (US); Jiwon L. Moran, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 324 days.

(21) Appl. No.: 14/731,113

(22) Filed: Jun. 4, 2015

(51) Int. Cl.

| | |
|---|---|
| ***H01Q 13/00*** | (2006.01) |
| ***H01Q 21/20*** | (2006.01) |
| ***H01Q 13/02*** | (2006.01) |
| ***H01Q 5/55*** | (2015.01) |
| ***H01Q 13/08*** | (2006.01) |
| *H01Q 1/28* | (2006.01) |
| *H01Q 1/32* | (2006.01) |
| *H01Q 1/34* | (2006.01) |

(52) U.S. Cl.
CPC ..... *H01Q 21/205* (2013.01); *H01Q 5/55* (2015.01); *H01Q 13/0275* (2013.01); *H01Q 13/085* (2013.01); *H01Q 1/28* (2013.01); *H01Q 1/32* (2013.01); *H01Q 1/34* (2013.01)

(58) Field of Classification Search
CPC .. H01Q 13/02; H01Q 21/205; H01Q 13/0275; H01Q 5/55; H01Q 13/085; H01Q 1/28; H01Q 1/32; H01Q 1/34
See application file for complete search history.

(56) References Cited

U.S. PATENT DOCUMENTS

| | | | | |
|---|---|---|---|---|
| 3,860,934 A * | 1/1975 | Cheo | H01Q 13/20 | 343/778 |
| 5,305,000 A * | 4/1994 | Harris | H01P 5/107 | 333/26 |
| 6,271,799 B1 * | 8/2001 | Rief | H01Q 13/0258 | 343/776 |
| 2002/0113745 A1 * | 8/2002 | Strickland | H01Q 13/0266 | 343/786 |
| 2009/0303147 A1 * | 12/2009 | Choudhury | H01Q 13/0283 | 343/776 |
| 2014/0253403 A1 * | 9/2014 | Walpole | H01Q 13/0275 | 343/786 |

* cited by examiner

*Primary Examiner* — Dieu H Duong
(74) *Attorney, Agent, or Firm* — Angel N. Gerdzhikov; Donna P. Suchy; Daniel M. Barbieri

(57) ABSTRACT

An antenna horn includes an upper waveguide ridge and a lower waveguide ridge shaped to provide impedance matching. The antenna horn operates unimodally within a 6:1 instantaneous bandwidth. A circular array of antenna horns produces an enhanced radiation pattern in a horizontal plane with reduced radiating in the direction orthogonal to the horizontal plane. Furthermore, two circular arrays of half-height antenna horns may be arranged on a collinear axis, offset by one half of a sector width as defined by each horn aperture to reduce coupling.

19 Claims, 10 Drawing Sheets

CIRCULAR ARRAY OF RIDGED WAVEGUIDE HORNS

BACKGROUND

Radio Frequency (RF) networked communication utilizes omnidirectional antennas; likewise, extended frequency tactical targeting network technology relies on omnidirectional antennas. Next generation Department of Defense directional communication systems require a dual mode directional/omnidirectional antenna array with 360° azimuthal coverage and high gain for anti-jam functionality that addresses anti-access, anti-denial (A2AD) threats.

Omnidirectional antennas in networked systems have reduced range due to low gain, broad beamwidth that makes the systems vulnerable to jamming, and are too large to mount on vehicles.

Ultra-wide band (UWB), i.e., 1-6 GHz, and electrically small, high gain, dual mode antennas are unknown in the art. State of the art antenna radiating elements typically have a minimum size of one quarter of the wavelength at the lowest frequency ($\lambda/4$ at 1 GHz). Monopole radiating elements are too physically tall to operate at 1 GHz.

Instantaneous bandwidth Balanced Antipodal Vivaldi Antenna (BAVA) circular arrays have adequate bandwidth, but also exhibit high Q nulls which deteriorate sectorial elevation coverage.

Consequently, it would be advantageous if an apparatus existed that is suitable for use as an antenna operable in the L-band, with physical characteristics suitable for mounting on a vehicle.

SUMMARY

Accordingly, embodiments of the inventive concepts disclosed herein are directed to a novel apparatus for use as an antenna operable in the L-band, with physical characteristics suitable for mounting on a vehicle.

In one aspect, embodiments of the inventive concepts disclosed herein are directed to an antenna horn which includes an upper waveguide ridge and a lower waveguide ridge. The upper and lower waveguide ridges are shaped to provide impedance matching. The antenna horn is configured to operate across a 6:1 instantaneous bandwidth, for example 1-6 GHz, while operating in its fundamental $TE_{10}$ mode and suppressing higher order modes, especially the critical ones (such as $TE_{30}$) in one particular embodiment. A circular array of antenna horns according to such embodiment produces an enhanced radiation pattern in a horizontal plane with reduced radiating in the direction orthogonal to the horizontal plane.

In a further aspect, embodiments of the inventive concepts disclosed herein are directed to a first circular array of half-horns, each having a single waveguide ridge, is configured to transmit in a frequency range across a 6:1 instantaneous bandwidth in either directional or omni directional modes. A corresponding second circular array of half-horns is configured to receive a directional or omnidirectional signal. The first circular array and second circular array are arranged on a collinear axis, offset by one half of a sector width as defined by each horn aperture.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the present disclosure may be better understood by those skilled in the art by reference to the accompanying figures in which.

DETAILED DESCRIPTION

Reference will now be made in detail to the subject matter disclosed, which is illustrated in the accompanying drawings. The scope of the inventive concepts disclosed herein is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
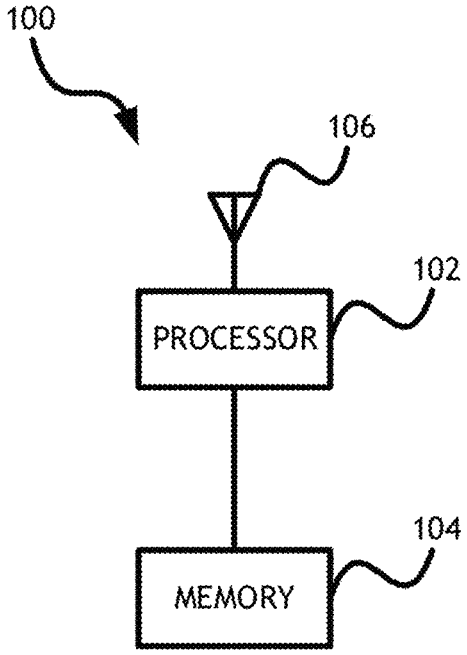
FIG. 1 shows a computer system suitable for implementing embodiments of the inventive concepts disclosed herein.

Referring to FIG. 1, a computer system 100 suitable for implementing embodiments of the inventive concepts disclosed herein is shown. The computer system 100 includes a processor 102 and memory 104 connected to the processor 102 for embodying processor executable code. An antenna 106 is connected to the processor 102 through a feed layer configured to excite elements in the antenna 106 to produce a transmission signal or receive a signal through the antenna 106.

An antenna 106 according to some embodiments of the inventive concepts disclosed herein includes a plurality of double ridge waveguide horn structures. The plurality of double ridge waveguide horn structures are arranged for directional or omnidirectional transmission. Each horn structure is connected to a transmit/receive module, or transceiver, to activate the desired radiation. The antenna/transceiver (aka active horn) assembly is controlled by the processor 102 and memory 104. Additionally, active cancelling circuitry may be included to further decrease parasitic mutual coupling between any two given active horn assemblies.

Alternatively, an antenna 106 according to some embodiments of the inventive concepts disclosed herein may include a first plurality of single ridge waveguide half-horn structures arranged for directional or omnidirectional transmission and a second plurality of single ridge waveguide half-horn structures arranged for signal reception, the first plurality of single ridge waveguide half-horn structures offset from the second plurality of single ridge waveguide half-horn structures to reduce coupling. Proper transceiver operation requires low sector-to-sector coupling, including horizontal, vertical, and transmitter to receiver diagonal coupling.

Figure 2:
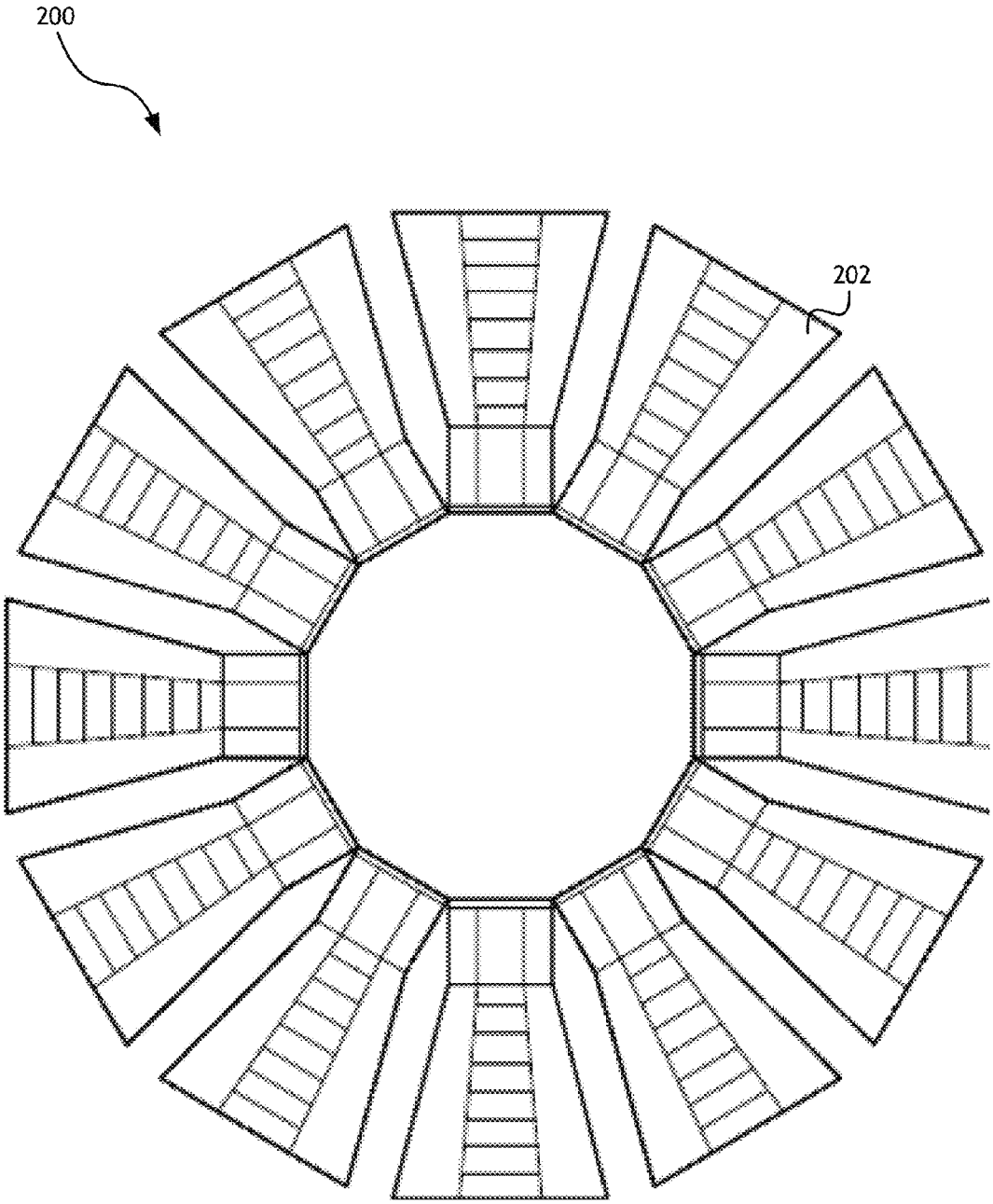
FIG. 2 shows a top view of an antenna array including embodiments according to the inventive concepts disclosed herein.

Referring to FIG. 2, a top view of an antenna 200 according to an exemplary embodiment of the inventive concepts disclosed herein is shown. The antenna 200 includes a plurality of double ridge waveguide horns 202 arranged in a circular configuration such that the output portion of each double ridge waveguide horn 202 is oriented toward a circumference of a circle defined by the double ridge waveguide horns 202 in the antenna 200. Each double ridge waveguide horn 202 is associated with a portion of the circumference such that the plurality of double ridge waveguide horns 202 covers the entire circumference during transmission or transmission and reception. The double ridge waveguide horns 202 can operate in either a direction mode (a single double ridge waveguide horn 202 or a small number of double ridge waveguide horns 202 in concert), or together in an omnidirectional pattern. The circular configuration produces a particular radiation pattern having accentuated transmission power along the horizon and minimized transmission power in the direction of the zenith, desirable for certain types of transmissions, with a minimized antenna 200 diameter.

UWB monopole type radiating elements are typically $\lambda/4$ tall at the lowest operating frequency. In the L-band, antennas, particularly circular antennas, including such elements are too large to mount to vehicles. or other platforms requiring a low profile, such as aircraft, etc. Embodiments of the inventive concepts disclosed herein may be useful in producing an antenna 200 with UWB monopole type radiating elements that is small enough to be mounted to the surface of a vehicle.

In the embodiment shown in FIG. 2, the antenna 200 is divided into twelve sectors, each corresponding to a double ridge waveguide horn 202. Depending on the sectorial coverage and sectorial crossover of the double ridge waveguide horns 202, twelve sectors may corresponds to the minimum number of double ridge wave horns 202 necessary to cover the entire horizon azimuthally and optimize sector cross-over performance for certain applications; however any number of sectors is contemplated.

In another embodiment, an antenna 200 divided into a plurality of sectors comprises a first layer of double ridge waveguide horns 202 configured to transmit and a second layer of double ridge waveguide horns 202 configured to receive. The first layer and second layer are substantially coaxial.

Transmit (Tx) and receive (Rx) circuits may be connected to each double ridge waveguide horn 202 through perpendicular or inline connector-less transitions such as a microstrip-to-coax connection, stripline-to-coax connection, coplanar waveguide (CPW)-to-coax connection, CPW directly to an upper or lower ridge, or any other appropriate electronic connection.

Figure 3:
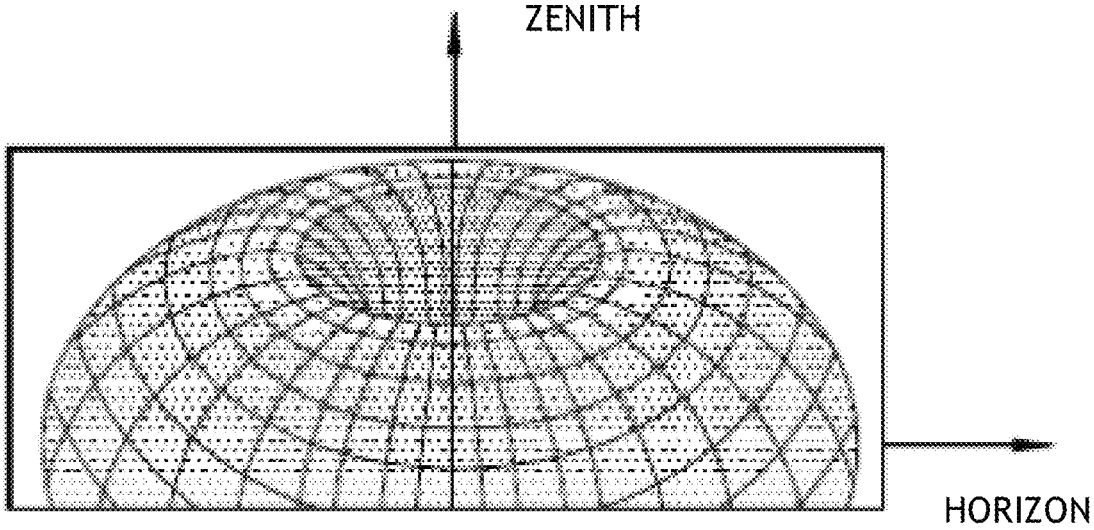
FIG. 3 shows an idealized representation of a monopole radiation pattern produced by embodiments of the inventive concepts disclosed herein.

Referring to FIG. 3, an idealized representation of a monopole radiation pattern produced by embodiments of the inventive concepts disclosed herein is shown. All of the horns are activated in this mode, which is the omnidirectional mode. The directional mode also has narrow beam within the azimuthal plane to create sector-to-sector directionality for lower probability of interference (LPI) and low probability of detection (LPD) operation. Embodiments of the present disclosure produce a radiation pattern having enhanced transmission power in the horizontal plane and minimized transmission power toward the zenith.

Figure 4:
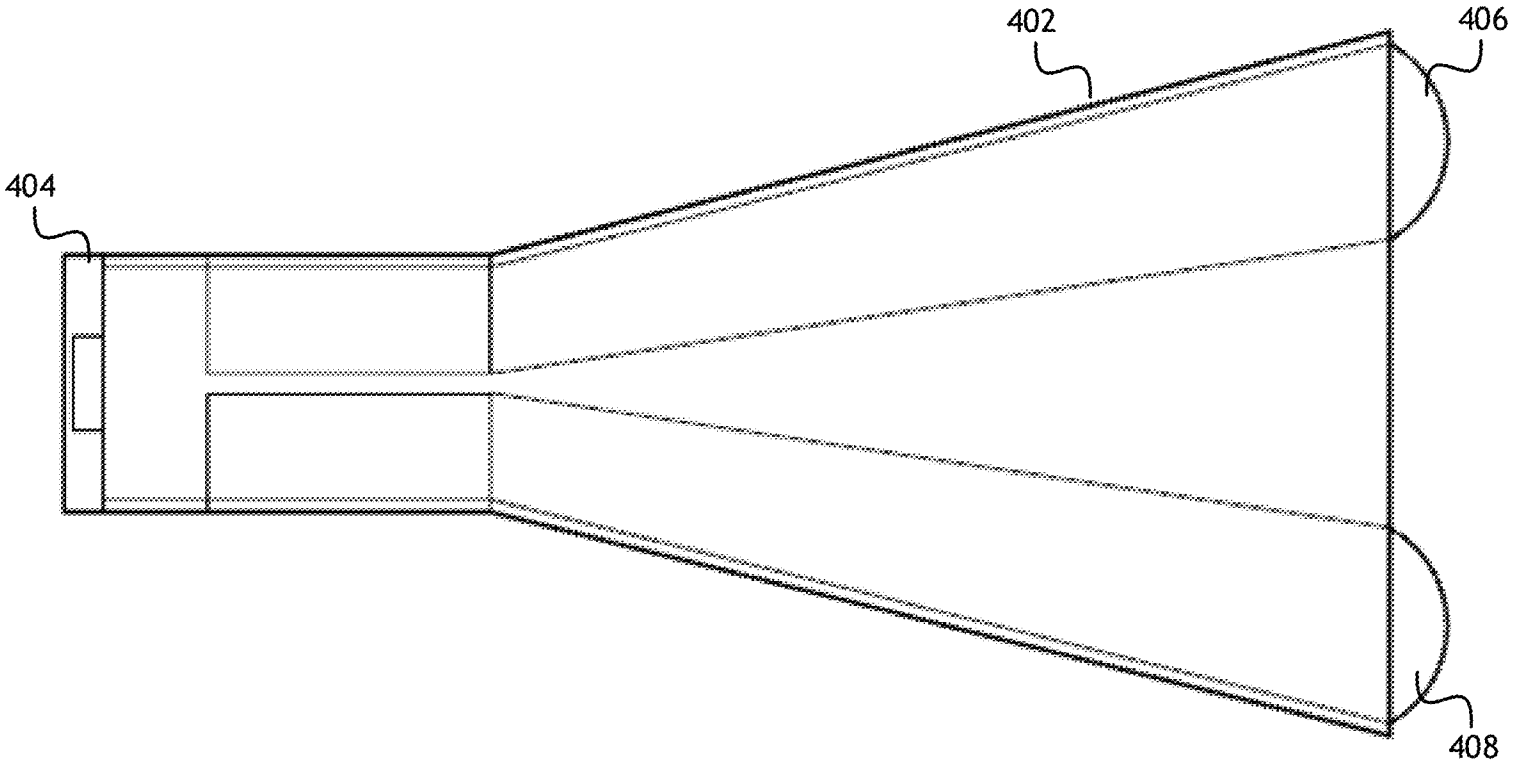
FIG. 4 shows a side view of one embodiment of the inventive concepts disclosed herein.

Referring to FIG. 4, a side view of an embodiment of a double ridge waveguide horn 402 includes a transition between the radiating horn and the feed transmission line 404 for receiving a signal from a feed layer and producing an electromagnetic signal. Such electromagnetic signal is channeled along an upper ridge 406 and lower ridge 408 and radiations outside the aperture of the horn. A double ridge waveguide horn 402. The double ridge waveguide horn 402 may produce an antenna having return loss of less than −10 dB and first side lobe approximately −20 dB or less in the H-plane and −13 dB in the E-plane depending on the operating range of the antenna. A person skilled in the art should appreciate that these return loss and side lobe power specifications are exemplary in nature and specific to certain embodiments. Such specifications should not be considered limiting.

Tx and Rx circuits may be connected to the feed transmission line 404 through perpendicular or inline connector-less transitions such as a microstrip-to-coax connection, stripline-to-coax connection, coplanar waveguide (CPW)-to-coax connection, CPW directly to the upper ridge 406 or the lower ridge 408, or any other appropriate electronic connection.

The upper ridge 406 and the lower ridge 408 change in both width and height as a function of axial length to obtain impedance matching to free space while maintaining broad bandwidth.

Embodiments of the inventive concepts disclosed herein may be fabricated by a computer numeric control (CNC) metal cutting process, metallic coated injection molded plastic, metallic coated 3D additive printing, rapid prototype manufacture, or any other fabrication process suitable for manufacturing antenna elements. A plated plastic assembly may be distorted to conformally mount to a single-curved or double-curved mounting surface to minimize visual signature and improve aerodynamics. Single or double curved mounting surfaces may comprise an aircraft fuselage, ground vehicle roof or trunk, maritime fuselage, missile, or rocket.

Figure 5:
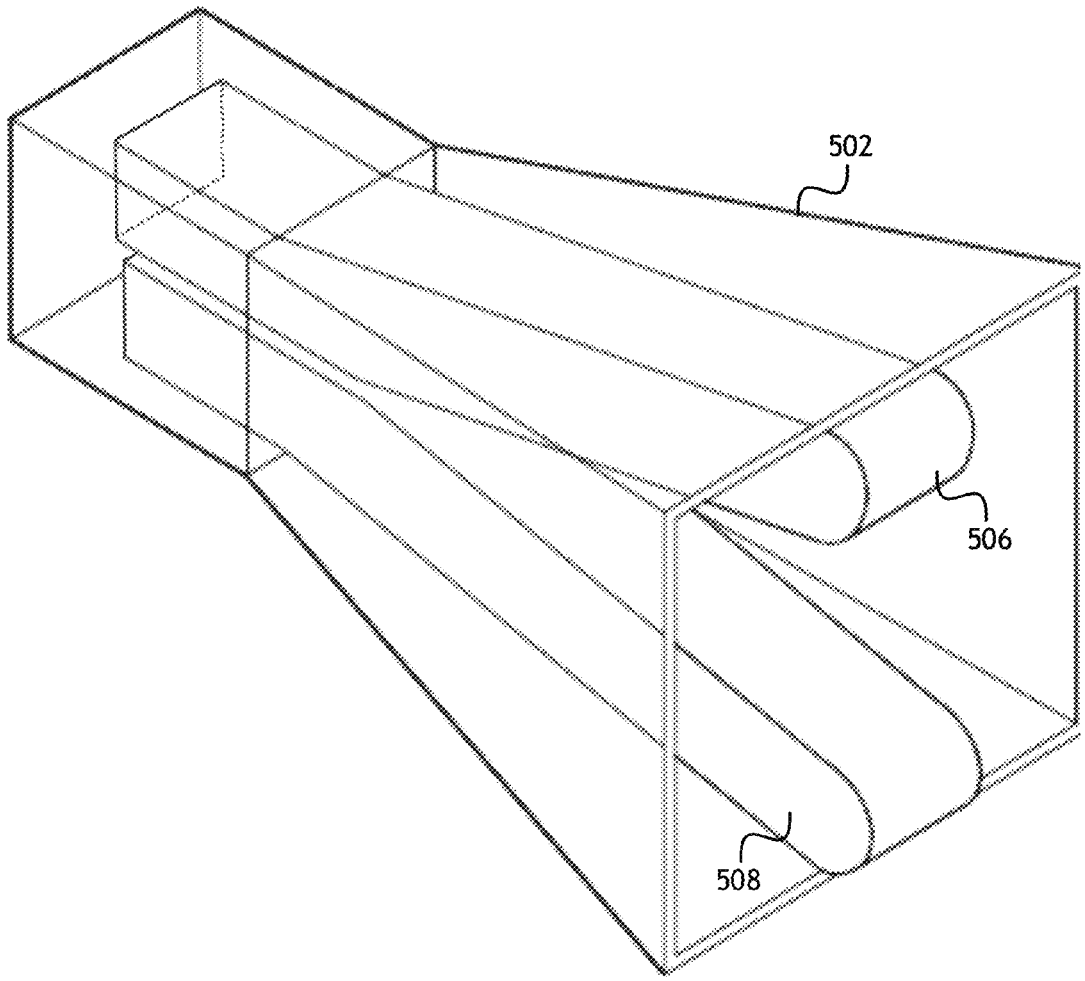
FIG. 5 shows a perspective view of one embodiment of the inventive concepts disclosed herein.

Referring to FIG. 5, a perspective view of a double ridge waveguide horn 502 according to an exemplary embodiment of the inventive concepts disclosed herein includes an upper ridge 506 and a lower ridge 508 for directing an electromagnetic wave to produce a radiation pattern in conjunction with other double ridge waveguide horns 502. Each of the upper ridge 506 and the lower ridge 508 are designed for UWB 6:1 instanteous bandwidth, which is the unimodal bandwidth of the dual or single ridge 506 and 508 waveguide, and minimal size. The upper ridge 506 and the lower ridge 508 width and the height determine the cutoff frequency and characteristic impedance of the double ridge waveguide horn 502. In one embodiment, the upper ridge waveguide horn 502506 and lower ridge 508 dimensions are chosen to produce a cutoff below 0.8 GHz and above 6.1 GHz, and the aperture is optimally sized to minimize sector-cross over gain modulation over the 1-6 GHz L-band. The double ridge waveguide horn 502 may have a higher cutoff.

Each of the upper ridge 506 and the lower ridge 508 dimensions are flared or tapered along an axial length of the double ridge waveguide horn 502 to enable impedance matching from a characteristic impedance ($Zo=50\Omega$) (or any desired systems characteristic impedance) to free space impedance ($\eta$=377Ω), and enable efficient radiation from the open end of the double ridge waveguide horn 502.

In one exemplary embodiment, a double ridge waveguide horn 502 may be configured to operate in the L-band as described herein and may have a width of approximately 15 centimeters, a height of approximately 10 centimeters, and a length of approximately 19 centimeters. A person skilled in the art may appreciate that the dimensions used herein are directed toward the horn 502 and not either the upper ridge 506 or lower ridge 508 as the dimensions of the upper ridge 506 and the lower ridge 508 lower ridge 508 are variable. Each of the upper ridge 506 and lower ridge 508 of a double ridge waveguide horn 502 according to this embodiment may have a maximum width of approximately 7.6 centimeters, a maximum height of approximately 3.7 centimeters, and a maximum length of approximately 5.9 centimeters. The wall thickness of the double ridge waveguide horn 502, the upper ridge 506, and the lower ridge 508 is approximately 0.635 centimeters. The horn 502 thickness is dependent on the particular fabrication process utilized; it is desirable to minimize the wall thickness while retaining mechanical rigidity.

Figure 6:
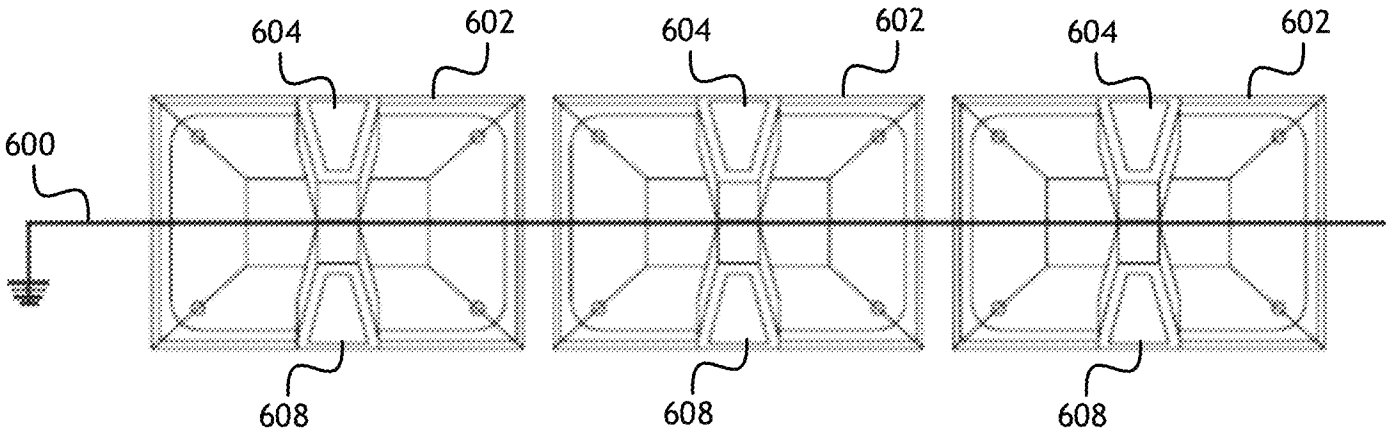
FIG. 6 shows a portion of an antenna array including embodiments according to the inventive concepts disclosed herein.

Referring to FIG. 6, a portion of an antenna array including a plurality of double ridge waveguide horns 602 each having an upper ridge 604 and a lower ridge 608 for directing an electromagnetic wave to produce a radiation pattern in conjunction with one another double ridge waveguide horns 602. A feed layer induces the electromagnetic wave in each double ridge waveguide horn 602 with reference to a ground plane or virtual ground plane 600. The antenna array produces a two layer vertically stacked Tx/Rx structure. In one embodiment, the two-layer vertically stacked structure comprises a twelve sector Rx array atop a twelve sector Tx array.

Figure 7:
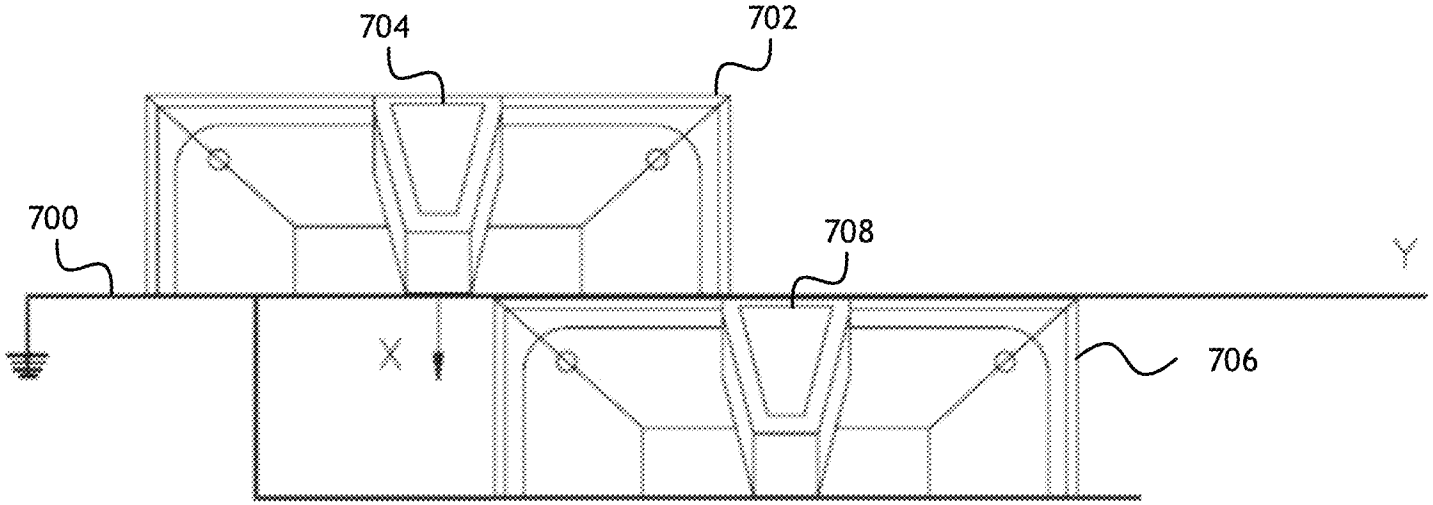
FIG. 7 shows a portion of an antenna array including embodiments according to the inventive concepts disclosed herein.

Referring to FIG. 7, a portion of an antenna array including a first plurality of single ridge waveguide half horns 702 each include a ridge 704 for directing an electromagnetic wave to produce a radiation pattern from signals received from a feed layer with reference to a common ground plane 700. A second plurality of single ridge waveguide half horns 706 each include a ridge 708, each single ridge waveguide horn 706 configured to receive signals from a direction corresponding to an opening of the single ridge waveguide half horns 706. In one embodiment, the first plurality of single ridge waveguide half horns 702 and second plurality of single ridge waveguide half horns 706 may be stacked such that the horns 702, 706 have a substantially similar orientation and have separate, though connected ground planes 700. In another embodiment, the first plurality of single ridge waveguide half horns 702 and second plurality of single ridge waveguide half horns 706 may be mirrored such that the horns 702, 706 have a substantially opposite orientation and share the same ground plane 700.

The first plurality of single ridge waveguide half horns 702 is offset from the second plurality of single ridge waveguide half horns 706 to prevent coupling between electronics associated with the first plurality of single ridge waveguide half horns 702 and electronics associated with the second plurality of single ridge waveguide half horns 706. In one embodiment, each single ridge waveguide half horn 702 in the first plurality is offset from a corresponding single ridge waveguide half horn 706 in the second plurality such that the single ridge waveguide half horn 702 in the first plurality does not overlap at all with the single ridge waveguide half horn 706 in the second plurality. Such a configuration may limit the number of single ridge waveguide half horns 702 and 706. In the any operational bandwidth such as the L-band and portions of the C-band, conventional circular antennas are typically too large to mount to vehicles. Further, the need for co-located Tx and Rx sectored arrays double the array size problem. In contrast, a circular antenna array with offset single ridge waveguide half horns 702 and 706 for reception and transmission according to embodiments of the present disclosure may provide omnidirectional and directional modes within an antenna array suitable for mounting to a vehicle.

The single ridge waveguide half horns 702 and 706 share the ground plane 700 with corresponding Tx and Rx circuits on opposite sides of the ground plane 700 relative to their respective single ridge waveguide half horns 702 and 706.

In one exemplary embodiment, a single ridge waveguide half horn 702 or 706 configured to operate in the L-band as described herein may have a width of approximately 15.9 centimeters, a height of approximately 6.8 centimeters, and a length of approximately 14.8 centimeters. Furthermore, each waveguide half horn 702, 706 may have a width of approximately 8.4 centimeters, a height of approximately 2.4 centimeters, and a length of approximately 3.3 centimeters. The wall thickness of the single ridge waveguide half horn 702 and ridge 706 is approximately 0.64 centimeters.

Figure 8:
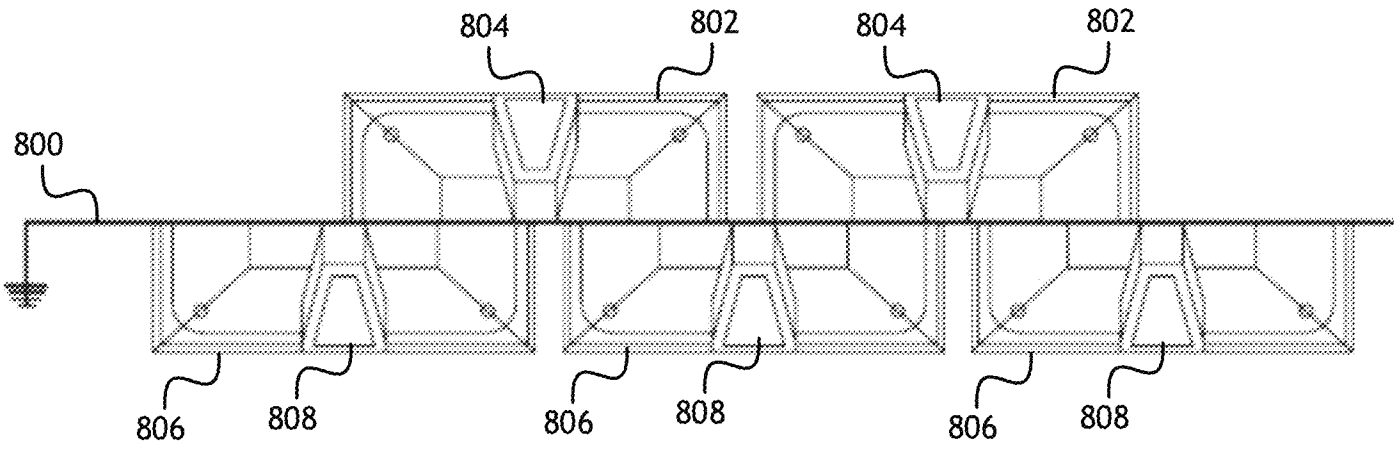
FIG. 8 shows a portion of an antenna array including embodiments according to the inventive concepts disclosed herein.

Referring to FIG. 8, a portion of an antenna array including embodiments according to the present disclosure is shown. In one embodiment, a first plurality of single ridge waveguide half horns 802 each include a ridge 804 for directing an electromagnetic wave to produce a radiation pattern from signals received or transmitted from a ground layer 800. A second plurality of single ridge waveguide half horns 806 a ridge 808, each configured to receive or transmit signals from a direction corresponding to an opening of the single ridge waveguide half horns 806.

The first plurality of single ridge waveguide half horns 802 is offset from the second plurality of single ridge waveguide half horns 806 to minimize mutual coupling between electronics associated with the first plurality of single ridge waveguide half horns 802 and electronics associated with the second plurality of single ridge waveguide half horns 806. In one embodiment, each single ridge waveguide half horn 802 in the first plurality is offset from a corresponding single ridge waveguide half horn 806 in the second plurality by one half of the sector angle such that the ridge 804 of the single ridge waveguide half horn 802 in the first plurality is maximally offset from the ridge 808 of the single ridge waveguide half horn 806 in the second plurality when each of the first plurality of single ridge waveguide half horns 802 and second plurality of single ridge waveguide half horns 806 are configured for maximum signal coverage to create minimal diagonal mutual coupling.

Figure 9:
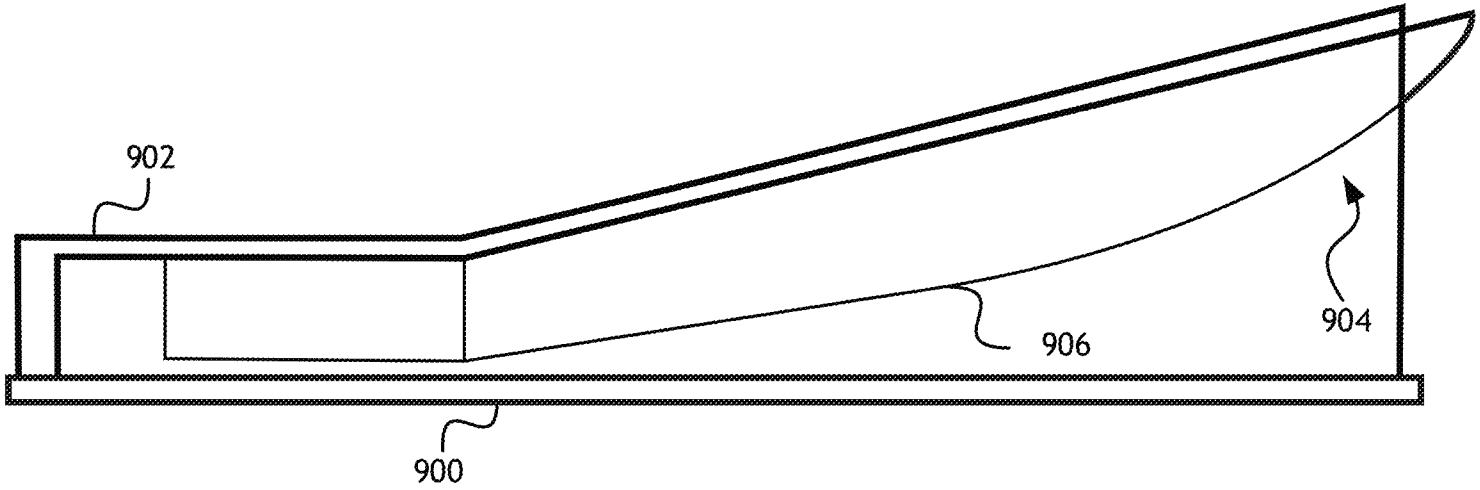
FIG. 9 shows a side view of one embodiment of the inventive concepts disclosed herein.

Referring to FIG. 9, a side view of a single ridge waveguide half horn 902 according to an exemplary embodiment of the inventive concepts disclosed herein is shown. The single ridge waveguide half horn 902 has a ground plane 900 connecting the single ridge waveguide half horn 902 to a coax element for receiving a signal from a feed layer and producing an electromagnetic signal. Such electromagnetic signal is channeled along a ridge 906. A single ridge waveguide half horn 902 according to embodiments of the present disclosure may produce an antenna having low return loss of less than −10 dB and low side lobes of less than −20 dB. In one embodiment, the ridge 906 may have a substantially parabolic portion 904 proximal to the aperture of the single ridge waveguide half horn 902. The substantially parabolic portion 904 may extend beyond the aperture opening of the horn 902. Furthermore, the substantially parabolic portion 904 may be shaped for optimal impedance matching to free space.

Figure 10:
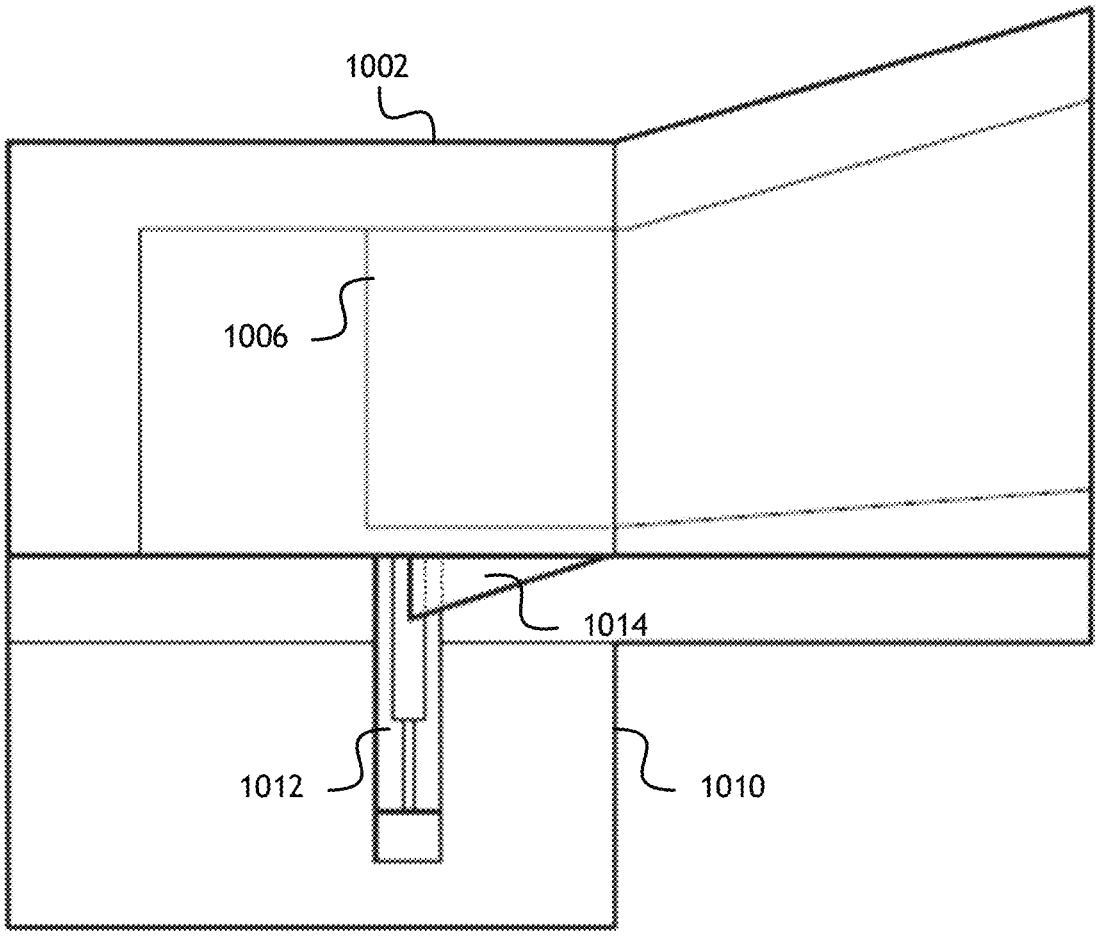
FIG. 10 shows a detail side view of one embodiment of the inventive concepts disclosed herein.

Referring to FIG. 10, a detail side view of a single ridge waveguide half horn 1002 according to an exemplary embodiment of the inventive concepts disclosed herein is shown. The single ridge waveguide half horn 1002 includes a ridge 1006 for directing an electromagnetic wave to produce a radiation pattern from signals received from a feed layer 1010. A feed layer engaging two-step coax feed element 1012 receives a signal from the feed layer 1010 and directs the signal to the single ridge waveguide half horn 1002. The two-step coax feed element 1012 generates broadband (6:1 bandwidth) 50-33-23 ohm impedance matching, where the input signal is 50 ohms, the second coax section is 33 ohms and the single ridge waveguide horn assembly is 23 ohms. The single ridge waveguide half horn 1002 may further include a resonating cavity 1014 defined by the single ridge waveguide half horn 1002 or feed layer 1010 to further facilitate impedance matching to the single ridge waveguide half horn 1002, in such a way as to extinguish the undesired $TE_{30}$ higher order waveguide mode. The resonance cavity 1014 provides source impedance and extra capacitance to produce a smooth transition for impedance matching. The design of the resonating cavity 1014 and ridge 1006 improves return loss due to the mismatch into the vertical coaxial feed.

In one exemplary embodiment, the resonating cavity 1014 has a width (direction orthogonal to the plane of the drawing) of approximately 1.78 centimeters, a length of approximately 0.99 centimeters, and a height of approximately 0.14 centimeters.

Broadband impedance matching is further adjustable based on "Top side" auxiliary impedance matching in the intra-sector RF transceiver's printed circuit, or impedance matching above or below the coaxial feed section of the horn.

Embodiments of the present disclosure enable an electrically small UWB sectored array with optimal sector crossover gain performance. Radiating elements according to embodiments of the present disclosure may have an improved front/back ratio, low side lobes, and beamwidth for sector array applications. A sector array utilizing embodiments of the present disclosure may have a 10 centimeter height in a two layer array, and a radius or approximately 33 centimeters.

It is believed that the present disclosure and many of its attendant advantages will be understood by the foregoing description of embodiments of the present disclosure, and it will be apparent that various changes may be made in the form, construction, and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. An antenna horn comprising:

a body having:

a radiating portion; and an aperture portion;

a resonating cavity defined by the body and a two-step coaxial feed element;

a first waveguide ridge disposed on an internal surface of the body along an axis defined by the radiating portion and the aperture portion, the first wave guide ridge extending beyond the aperture portion; and a second waveguide ridge disposed on an internal surface of the body, along an axis defined by the radiating portion and the aperture portion, the second wave guide ridge extending beyond the aperture portion, wherein:

the resonating cavity is configured to suppress a TEN) mode; and the antenna horn is configured to operate with a 6:1 instantaneous bandwidth.

2. The antenna horn of claim 1, wherein the body, first waveguide ridge, and second waveguide ridge comprise metal coated plastic.

3. The antenna horn of claim 1, wherein:

the first waveguide ridge comprises a variable width cross section; and the second waveguide ridge comprises a variable width cross section.

4. The antenna horn of claim 3, wherein:

the first waveguide ridge comprises a variable height cross section; and the second waveguide ridge comprises a variable height cross section.

5. The antenna horn of claim 1, wherein the each of the first waveguide ridge and second waveguide ridge is configured for impedance matching between a characteristic impedance at the radiating portion and a free space impedance at the aperture portion.

6. An antenna comprising:

a plurality of antenna horns, each of the antenna horns comprising:

a body having:

a radiating portion; and an aperture portion;

a first waveguide ridge disposed on an internal surface of the body along an axis defined by the radiating portion and the aperture portion;

a second waveguide ridge disposed on an internal surface of the body, along an axis defined by the radiating portion and the aperture portion; and a ground plane wherein a first set of antenna horns in the plurality of antenna horns is disposed on a first surface of the ground plane and a second set of antenna horns in the plurality of antenna horns is disposed on a second surface of the ground plane, wherein:

each of the antenna horns in the plurality of antenna horns is configured to operate with a 6:1 instantaneous bandwidth;

the first set of antenna horns in the plurality of antenna horns is organized in a circular array with each of the antenna horns in the first set of antenna horns corresponding to a sector in the circular array, the aperture portion proximal to a circumference of the circular array and the radiating portion distal to the circumference of the circular array;

the second set of antenna horns in the plurality of antenna horns is organized in a circular array with each of the antenna horns in the second set of antenna horns corresponding to a sector in the circular array, the aperture portion proximal to a circumference of the circular array and the radiating portion distal to the circumference of the circular array; and a center of the circular array of the first set of antenna horns being coaxial with a center of the circular array of the second set of antenna horns.

7. The antenna of claim 6, wherein the antenna is configured to produce an end-fire radiation pattern.

8. The antenna of claim 6, wherein the plurality of antenna horns comprises twelve horns, each of the twelve horns corresponding to a sector comprising one twelfth of the circumference of the circular array.

9. The antenna of claim 8, wherein the antenna is operable over the entirety of a horizon and produces an optimized sector cross-over performance.

10. An antenna comprising:

a first plurality of antenna horns, each of the antenna horns comprising:

a body having:

a radiating portion; and an aperture portion; and a waveguide ridge disposed on an at least partially parabolic internal surface of the body;

a second plurality of antenna horns, each of the antenna horns comprising:

a body having:

a radiating portion; and an aperture portion; and a waveguide ridge disposed on an at least partially parabolic internal surface of the body; and a ground plane wherein each of the first plurality of antenna horns is disposed on a first surface of the ground plane and each of the second plurality of antenna horns is disposed on a second surface of the ground plane, wherein:

each of the antenna horns in the first plurality of antenna horns is configured to operate in a frequency range between 1 GHz and 6 GHz; and the first plurality of antenna horns is organized in a circular array with each of the horns in the first plurality of antenna horns corresponding to a sector in the circular array, the aperture portion proximal to a circumference of the circular array and the radiating portion distal to the circumference of the circular arrays;

the second plurality of antenna horns is organized in a circular array with each of the horns in the second plurality of antenna horns corresponding to a sector in the circular array, the aperture portion proximal to a circumference of the circular array and the radiating portion distal to the circumference of the circular arrays, and a center of the circular array of the first plurality of antenna horns being coaxial with a center of the circular array of the second plurality of antenna horns;

each of the antenna horns in the second plurality of antenna horns is configured to transmit a signal; and each of the antenna horns in the second plurality of antenna horns is configured to receive signals in a frequency range between 1 GHz and 6 GHz.

11. The antenna of claim 10, wherein the waveguide ridge is configured for impedance matching between a characteristic impedance at the radiating portion and a free space impedance at the aperture portion.

12. The antenna of claim 10, further comprising a ground plane, wherein each of the first plurality of antenna horns is disposed on a surface of the ground plane.

13. The antenna of claim 12, further comprising a coax feed element associated with each of the first plurality of antenna horns, wherein the coax feed element configured to deliver a signal from a feed layer to the radiating portion.

14. The antenna of claim 13, wherein each coax feed element is configured for impedance matching between the feed layer and the associated radiating portion.

15. The antenna of claim 12, wherein the ground plane defines a resonating cavity associated with each of the first plurality of antenna horns, the resonating cavity configured for higher order mode suppression.

16. The antenna of claim 10, wherein the antenna horns in the first plurality of antenna horns are oriented such that they are stacked in relation to the horns in the second plurality of antenna horns.

17. The antenna of claim 10, wherein the first plurality of antenna horns is radially offset from the second plurality of antenna horns.

18. The antenna of claim 17, wherein the offset is substantially equal to one half of a width of one of the first plurality of antenna horns.

19. The antenna of claim 10, further comprising:

a first feed layer associated with the first plurality of antenna horns disposed on the second surface of the ground plane; and a second feed layer associated with the second plurality of antenna horns disposed on the first surface of the ground plane.

* * * * *